US005122107A

United States Patent [19]

Gardner

[11] Patent Number: 5,122,107

[45] Date of Patent: Jun. 16, 1992

[54] SITUP EXERCISE HEAD-SUPPORT HARNESS

[76] Inventor: William G. Gardner, 11642 Donna La., Garden Grove, Calif. 92640

[21] Appl. No.: 773,459

[22] Filed: Oct. 9, 1991

[51] Int. Cl.[5] ..... A63B 1/00

[52] U.S. Cl. ..... 482/140

[58] Field of Search ..... 272/70, 93, 139, 138, 272/142, 126; 128/80 G, 25 R

[56] References Cited

U.S. PATENT DOCUMENTS 3,442,513 5/1969 Fisher ..... 272/93

4,337,938 7/1982 Rodriquez ..... 272/93

FOREIGN PATENT DOCUMENTS 1081419 6/1954 France ..... 272/138

*Primary Examiner*—Stephen R. Crow

*Attorney, Agent, or Firm*—James D. Thackrey

[57] ABSTRACT

A harness to be worn during situp exercises, the benefit being that it provides a non-moving portion to support the head. The cross strap behind the head which constitutes this non-moving portion is mounted on straps held about eye level by the hands during situps, wound partially around the upper torso, and attached in front of the body to a belt.

2 Claims, 2 Drawing Sheets

SITUP EXERCISE HEAD-SUPPORT HARNESS

BACKGROUND OF THE INVENTION

1. Field of the Invention

Exercise apparatus consists of any sort of device which aids the performer of exercise. This invention is in that field, as a piece of equipment mounted on the body of the user during situp exercises to make the time spent exercising more closely directed to the purpose of the exercise—to strengthen the abdomen (stomach girdle) muscles.

2. Background of the Invention

Situps are a popular and effective method of strengthing the abdominal muscles. They can be done in many places with little preparation, and do not require that the user spend a lot of time to attain the degree of muscle use he desires. However, they do require that the neck and shoulder muscles which support the head be repeatedly stressed during the situp, and this factor has limited the popular use of situps as a convenient and appearance-improving exercise.

The typical head weighs about 14 pounds and is raised and lowered (using the neck muscles twice) each situp. Physical therapists and fitness personnel have used straps around the back of the head, pulled forward by the hands, in seeking to overcome the problem. This requires modulating the force applied by the hands twice each situp, and pulling at the wrong time results in distracting discomfort as the head is pulled forward to an unnatural position.

There exist harnesses in which two main straps pass from the hands directly over the shoulders, attaching to a belt. The head rests on a cross-strap behind the head. These harnesses exhibit the same problems, force modulation and coordination being required to avoid discomfort, though to a lesser degree. The belt also tends to ride upward with these harnesses.

SUMMARY OF THE INVENTION

My invention overcomes the problem discussed above by having the hands pull on straps which pass over the shoulders, cross at the center of the back, and extend around the sides to the front of the belt. Thus, as long as the hand's pull exceeds the weight of the head, any excess pull force is applied to the back and sides, since the straps are wrapped around those parts of the body. The back and sides do not move and the strap, being anchored to the belt which is held down by additional anchor straps leading to the feet, does not slide lengthwise freely. Therefore, the primary straps, and the secondary strap between them on which the head rests, move exactly synchronously with the back and sides. This effect, the staying of the head rest firmly in position, enables the user to pay attention to the situp itself and forget the cyclic strain on his neck because there is none. As long as he exerts enough hand force to overcome the weight of his head, any greater (or variable) force does not result in pulling his head forward.

Additionally, weights may be placed in a purse located on the chest to provide a greater challenge.

This invention in solving a longstanding problem with an excellent, useful exercise, is considered advancement on the prior art.

DETAILED DESCRIPTION

Figure 2:
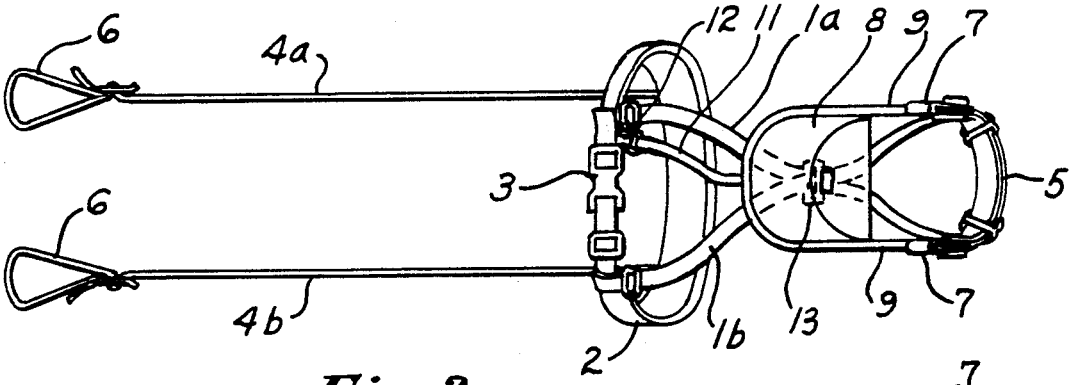
FIG. 2 is a front view of the invention.
Figure 1:
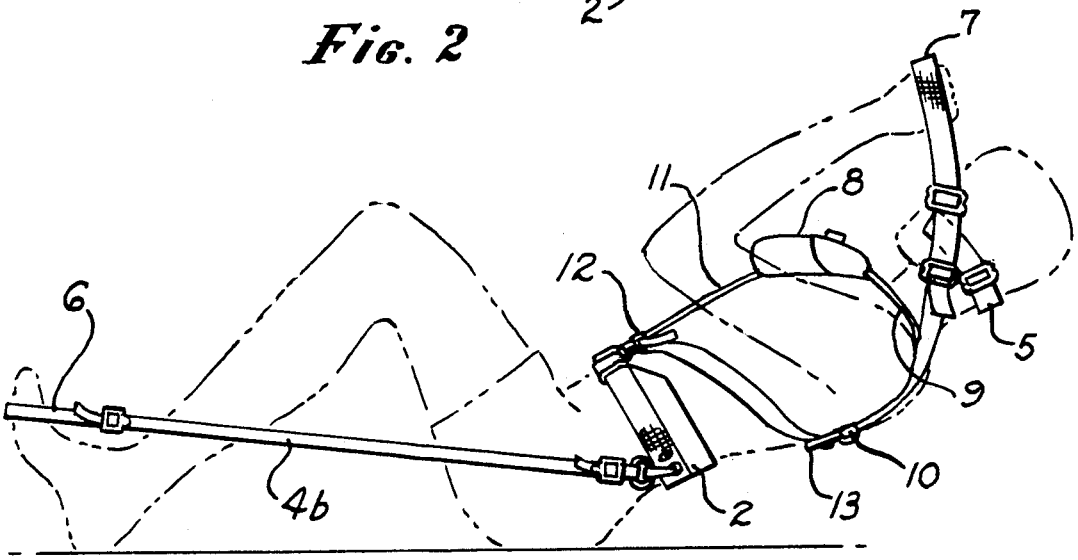
FIG. 1 is a side view of the harness in use.

The Summary explains the function of the various straps which make up my invention, with the exception of a weight purse (8) which may be used to increase the effort required to perform each situp. This description will cover all elements of the invention, it being understood that provisions for adjustment of the length of each strap would be part of the detailed construction of a preferred embodiment so as to accommodate users having different body measurements. So each strap and the belt is shown in the drawings as having adjustment means, using well known elements, without further comment.

Items 1*a* and 1*b* are the primary straps which partially encircle the upper torso, from in front of the body passing backwards over the shoulders, diagonally across the back, around the sides and fastening to the belt Item 2. Item 3 is the belt buckle.

Item 7 is a handgrip loop formed from the forward portion of primary strap 1.

Items 4*a* and 4*b* are the anchor straps, attached to belt 2 and passing down beside the leg to foot-receiving loop 6 fashioned on the end of strap 4.

Item 5 is the secondary strap, adjustably attached to primary straps 1 at its end points forward of the head, and long enough to extend around the back of the head. In use handgrip loops 7 are roughly at eye level so the back of secondary strap 5 abuts the lower part of the back of the head rather than the neck.

Item 13 is the primary strap crosspoint fitting, which engages loosely both primary straps 1 merely to keep them in place both during handling and donning of the harness. In the preferred embodiment, it also serves as a mounting surface for hook-and-loop (Velcro) pad 14 in the event weight purse 8 is used.

Figure 3:
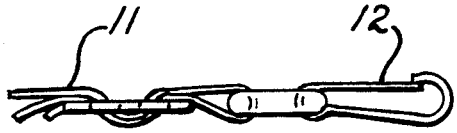
FIG. 3 is a side view of the preferred embodiment of the purse holddown strap fastener.
Figure 4:
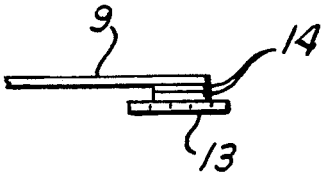
FIG. 4 is a side view of the preferred embodiment of the purse attachment strap fastener.
Figure 5:
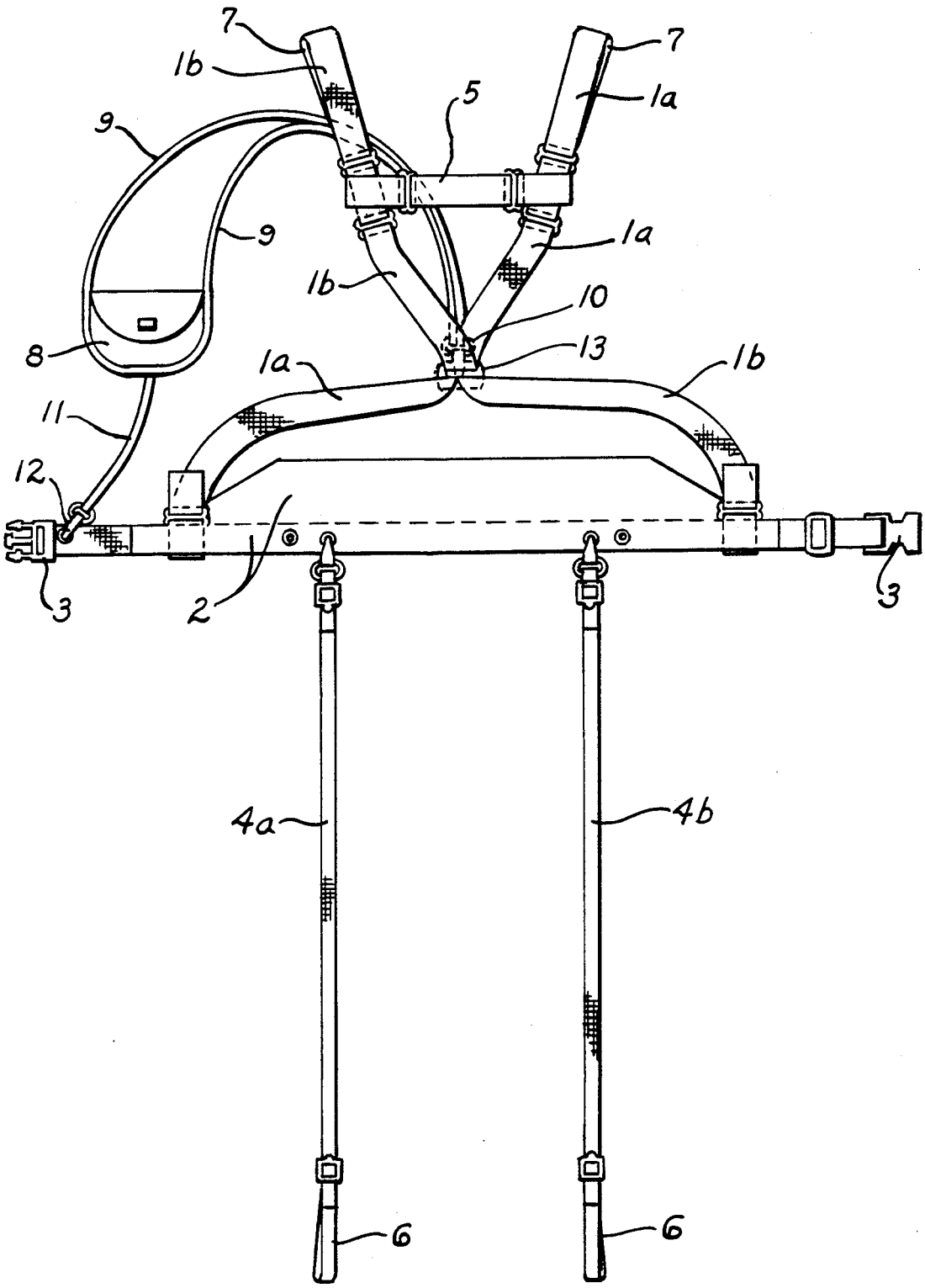
FIG. 5 is a view of all elements of the harness, distorted as would occur if laid out flat.

Purse attachment straps 9 are attached permanently to weight purse 8 and pass one on each side of the neck to the crossover point of primary straps 1, where they are removably fastened to fitting 13. The preferred embodiment of this purse attachment strap fastener, Item 10, is abutting hook-and-loop pads Item 14 as shown in FIG. 4. Obviously, other means of removably fastening straps 9 to fitting 13, such as the hook of FIG. 3, could be used.

Purse holddown strap Item 11, has one end attached to weight purse 8 and the other end attached to belt 2 by means of purse holddown strap fastener Item 12. The preferred embodiment is a safety hook as shown in FIG. 3, although several other types of fasteners 12 would be obvious to one skilled in the art.

Weight purse 8 functions as a secure means to contain virtually any weight the user chooses.

The invention having been described in its preferred embodiment, it is clear that modifications are within the ability of those skilled in the art without exercise of the inventive faculty. Accordingly, the scope of the invention is defined in the scope of the following claims:

I claim:

1. A situp exercise harness for reducing stress in the neck due to the force created by the weight of the head, comprising:

a belt passing around the body at the waist, and two primary straps each attached to said belt in front of the body passing around the side, diagonally across the back, over the shoulder near the neck, and upward therefrom, terminating in a handgrip loop, one said strap on each side of the body, and a secondary strap attached to and extending between said primary straps forward of the shoulder and passing behind the head, and two anchor straps running from said belt to the feet and terminating in a foot-receiving loop, whereby force to support the weight of the head is directly supplied through the handgrip loops, and excessive hand force does not reach the head but is applied by the primary straps to the upper torso, the belt, the anchor straps, and the feet, the secondary strap providing a stress free rest for the head and neck.

2. A device as in claim 1, further comprising a weight purse and two purse attachment straps extending from the crossover point of said primary straps over the shoulder on each side of the neck to the chest, where said straps are attached to said weight purse, and a purse attachment straps fastener removably fastening said purse attachment straps to said primary straps, and a purse holddown strap attached to said weight purse and extending to said belt, and a purse holddown strap fastener removably fastening said purse holddown strap to said belt.

* * * * *